US011422487B2

(12) United States Patent
Nakajima

(10) Patent No.: US 11,422,487 B2
(45) Date of Patent: Aug. 23, 2022

(54) IMAGING SYSTEM

(71) Applicant: Hewlett-Packard Development Company, L.P., Spring, TX (US)

(72) Inventor: Kensuke Nakajima, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/312,580

(22) PCT Filed: Jan. 14, 2020

(86) PCT No.: PCT/US2020/013481
§ 371 (c)(1),
(2) Date: Jun. 10, 2021

(87) PCT Pub. No.: WO2020/154131
PCT Pub. Date: Jul. 30, 2020

(65) Prior Publication Data

US 2022/0043371 A1 Feb. 10, 2022

(30) Foreign Application Priority Data

Jan. 22, 2019 (JP) ..... JP2019-008741

(51) Int. Cl.
*G03G 15/00* (2006.01)
*G03G 15/16* (2006.01)

(52) U.S. Cl.
CPC ..... *G03G 15/1615* (2013.01); *G03G 2215/00156* (2013.01)

(58) Field of Classification Search
CPC ..... G03G 15/0119; G03G 15/0189; G03G 15/161; G03G 15/1615; G03G 2215/0156; G03G 2215/0158; G03G 2215/1671; G03G 2215/1684
USPC ..... 399/162, 165, 302, 308
See application file for complete search history.

(56) References Cited

U.S. PATENT DOCUMENTS 5,956,553 A 9/1999 Park
6,181,900 B1 1/2001 Lee et al.
6,871,036 B2 * 3/2005 Asuwa ..... G03G 15/755 198/804

(Continued)

FOREIGN PATENT DOCUMENTS

CN 103832064 A 6/2014
JP 2001-122418 A 5/2001

(Continued)

*Primary Examiner* — Hoan H Tran
(74) *Attorney, Agent, or Firm* — Jefferson IP Law, LLP

(57) ABSTRACT

An imaging system includes an endless belt, a tension roller to engage the endless belt, a steering roller to contact the endless belt and a tilting mechanism to tilt the steering roller. The tension roller has a first end adjacent a first edge portion of the endless belt and a second end adjacent a second edge of the endless belt. A first belt meandering detection member is located at the first end of the tension roller. A second belt meandering detection member is located at the second end of the tension roller. The tilting mechanism operates the steering roller between a first mode wherein the first edge portion of the endless belt contacts the first belt meandering detection member, and a second mode wherein the second edge portion of the endless belt contacts the second belt meandering detection member.

15 Claims, 17 Drawing Sheets

(56) References Cited

U.S. PATENT DOCUMENTS

| | | | | |
|---|---|---|---|---|
| 9,141,041 | B2 * | 9/2015 | Kishi | G03G 15/1615 |
| 10,108,131 | B2 * | 10/2018 | Ueno | G03G 15/161 |
| 2008/0260424 | A1 | 10/2008 | Hara et al. | |
| 2012/0321328 | A1 | 12/2012 | Nakazato | |

FOREIGN PATENT DOCUMENTS

| | | | |
|---|---|---|---|
| JP | 2009-25475 | A | 2/2009 |
| JP | 2011-118326 | * | 6/2011 |
| JP | 2012-108219 | A | 6/2012 |

* cited by examiner

IMAGING SYSTEM

BACKGROUND

In some image forming systems, an endless belt is used as an intermediate transfer belt that transfers toner. The endless belt is stretched over a drive roller and a tension roller and moves in accordance with the rotational driving of the drive roller. Some image forming systems include a steering roller located inside the endless belt. The steering roller is tilted when the endless belt is displaced in the longitudinal direction of the drive roller or the tension roller. In this way, a displacement of the endless belt is corrected when the steering roller is tilted.

DETAILED DESCRIPTION

In the following description, with reference to the drawings, the same reference numbers are assigned to the same components or to similar components having the same function, and overlapping description is omitted.

The belt driving device of an imaging system may be used as a transfer device which secondarily transfers a toner image developed by a developing device of an imaging apparatus such as a printer. The belt driving device includes an endless belt which may be an intermediate transfer belt of the transfer device. The belt driving device may be used in a printing medium conveying device which conveys a printing medium such as a sheet. In this case, the endless belt of the belt driving device may function as a printing medium conveying belt which conveys a printing medium.

Figure 1:
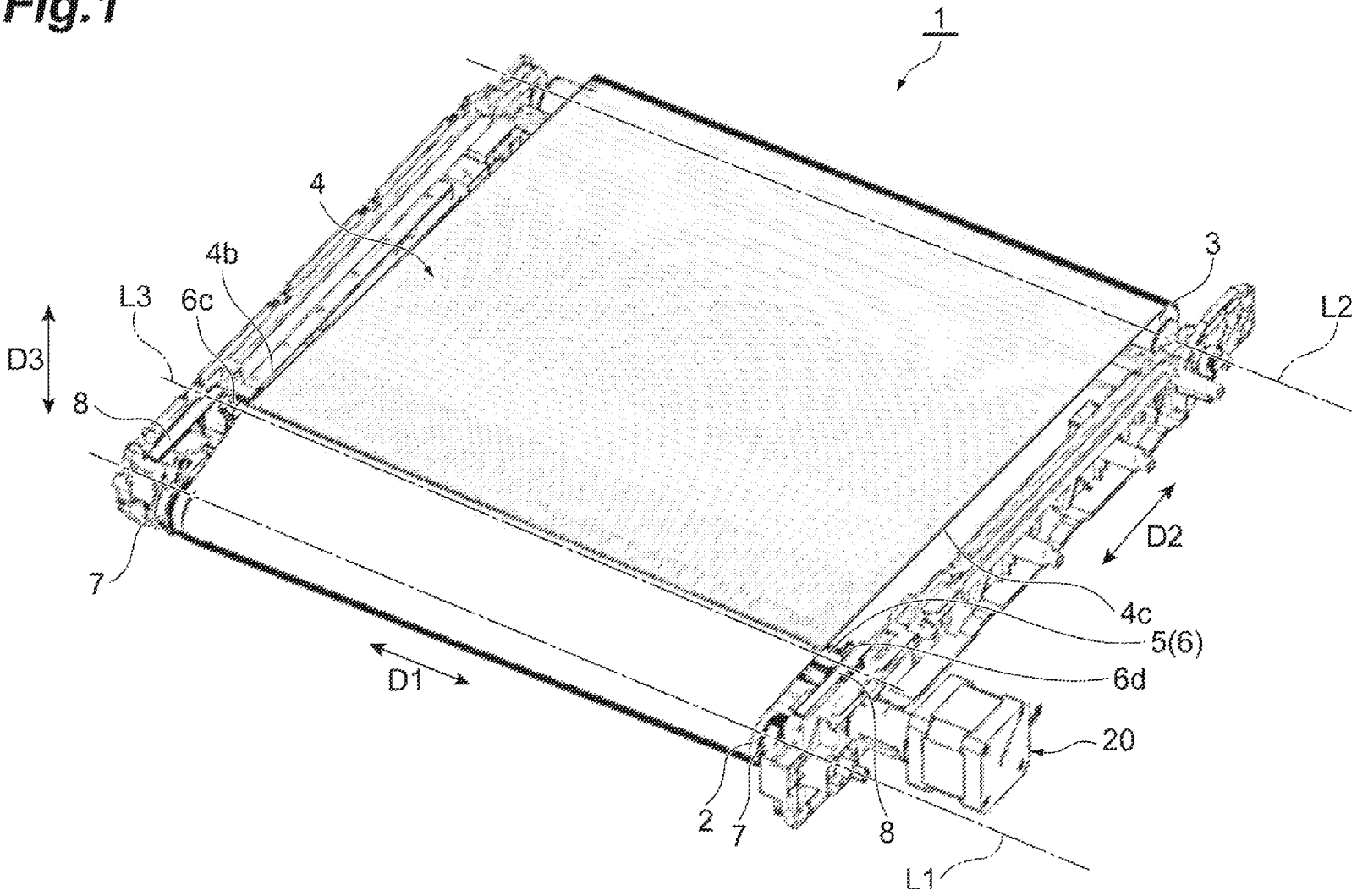
FIG. 1 is a perspective view of an example belt driving device of an example imaging system.

With reference to FIG. 1, an example belt driving device 1 includes a first belt roller 2, a second belt roller 3, and an endless belt 4 which is stretched over the first belt roller 2 and the second belt roller 3. Each of the first belt roller 2 and the second belt roller 3 may extend in a direction D1. The direction D1 may indicate the longitudinal directions of the first belt roller 2 and the second belt roller 3 and the width direction of the endless belt 4. The first belt roller 2 and the second belt roller 3 may face each other in a direction D2 intersecting the direction D1. The first belt roller 2 may be a drive roller which drives the endless belt 4. The second belt roller 3 may be a driven roller which follows the driving of the first belt roller 2. In some examples, the first belt roller 2 is a tension roller for tensioning the endless belt 4, and may receive power from an electric motor. The first belt roller 2 rotates about an axis L1 extending in the direction D1 by the power transmitted from the electric motor. In some examples, the endless belt 4 which is stretched over the first belt roller 2 and the second belt roller 3 moves in a circulating manner along the outer circumference of the first belt roller 2 and the outer circumference of the second belt roller 3 in the direction D2 as the first belt roller 2 rotates. The second belt roller 3 rotates about an axis L2 as the endless belt 4 moves.

Figure 2:
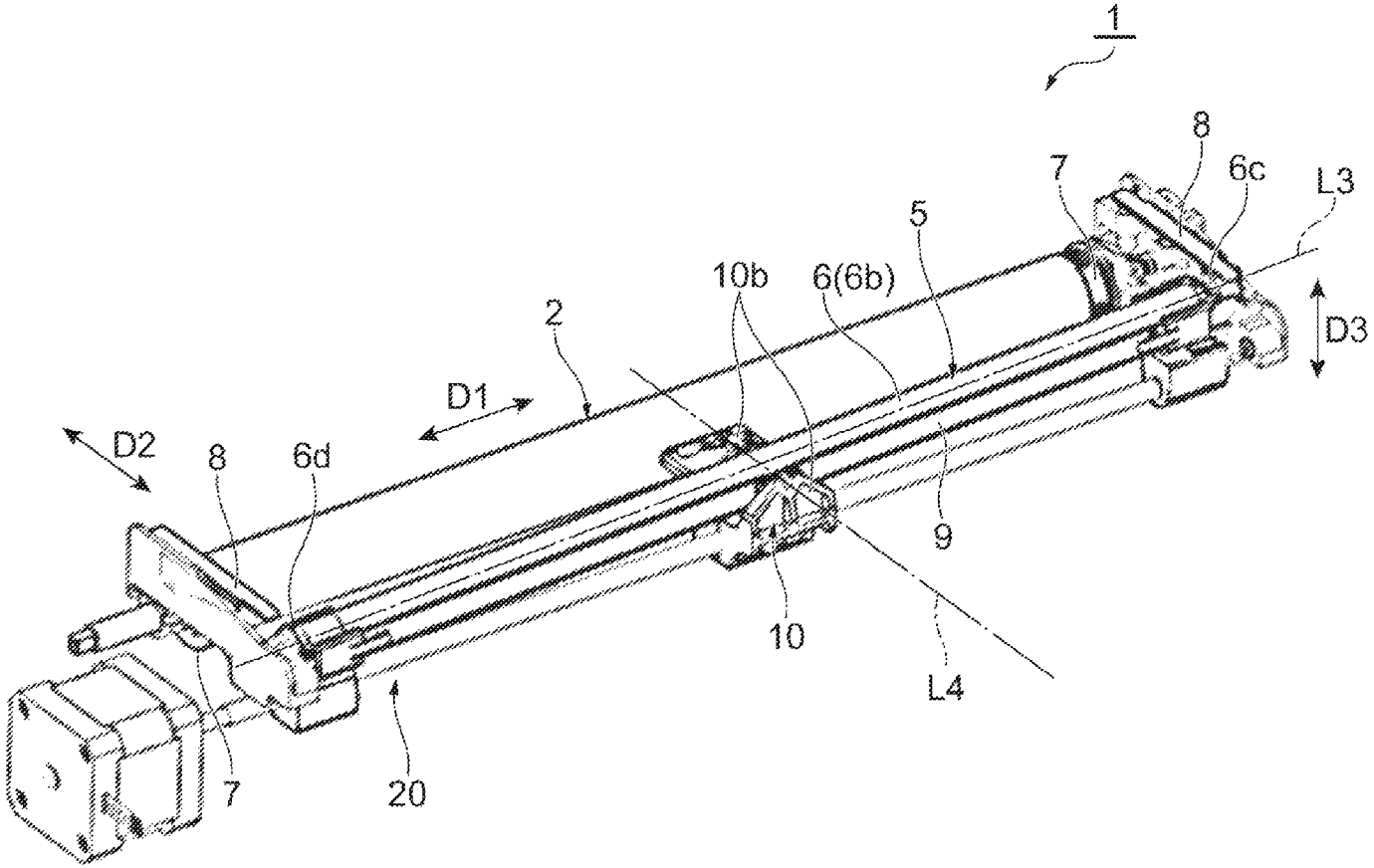
FIG. 2 is a perspective view of a steering member, a first belt roller, and a tilting mechanism of the belt driving device illustrated in FIG. 1.

With reference to FIGS. 1 and 2, the example belt driving device 1 may include a steering member 5 that corrects a displacement of the endless belt 4 in the direction D1. When the steering member 5 is pressed against the endless belt 4, the displacement of the endless belt 4 is corrected. In some examples, the steering member 5 includes a steering roller 6 which is located between the first belt roller 2 and the second belt roller 3 and inside the endless belt 4 and extends in the direction D1 and a pulley 7 and a lever mechanism 8 which are respectively provided in a first end 6*c* and a second end 6*d* of the steering roller 6. The endless belt 4 may include a first edge portion 4*b* (also referred to as first end portion 4*b*) which is located at one end of the direction D1, and a second edge portion 4*c* (also referred to as second end portion 4*c*) which is located at the other end of the direction D1. In some examples, the first edge portion 4*b* is adjacent to the first end 6*c* of the steering roller 6, and the second edge portion 4*c* is adjacent to the second end 6*d* of the steering roller 6.

In some examples, the steering roller 6 may be disposed at the upstream side of the first belt roller 2 and the downstream side of the second belt roller 3 in the circumferential movement direction of the endless belt 4. In this case, the steering roller 6 may be disposed at the upper side of the orbit of the endless belt 4 so as to come into contact with the inner circumferential surface of the endless belt 4 moving from the second belt roller 3 toward the first belt roller 2. In some examples, the steering roller 6 is disposed at a position close to the first belt roller 2 in relation to an intermediate point of the first belt roller 2 and the second belt roller 3.

An outer circumferential surface 6*b* of the steering roller 6 may come into contact with the inner circumferential surface of the endless belt 4. In some examples, the steering roller 6 rotates about an axis L3 in a driven manner as the endless belt 4 moves in a circulating manner. The first end 6*c* and the second end 6*d* which are respectively provided at both ends of the steering roller 6 may be rotatably supported by a bearing. Each of the first end 6*c* and the second end 6*d* may be movable in a direction D3 intersecting both of the direction D1 and the direction D2.

The example steering member 5 may include a support member 9 that extends in the direction D1 and a fixture 10 which is connected to the support member 9 at the center of the support member 9 in the direction D1. The support member 9 may extend in the longitudinal direction of the steering roller 6. The support member 9 may be disposed to cover the lower portion of the outer circumferential surface 6*b* of the steering roller 6. The fixture 10 may support the support member 9 in a swingable (or pivotable) manner. The fixture 10 may include a pair of clamping portions 10*b* which clamps the support member 9 from both sides of the direction D2. Each of the pair of clamping portions 10*b* may be connected to the support member 9.

The steering roller 6 may be swingable (or tiltable) about an axis L4 which passes through the fixture 10 and extends in the direction D2. In this case, each of the first end 6*c* and the second end 6*d* of the steering roller 6 pivots (or swings) along the direction D3, about the axis L4. In some examples, the steering roller 6 is tiltable by using the pair of clamping portions 10*b* as a fulcrum when one of the first end 6*c* and the second end 6*d* is pressed.

Figure 3:
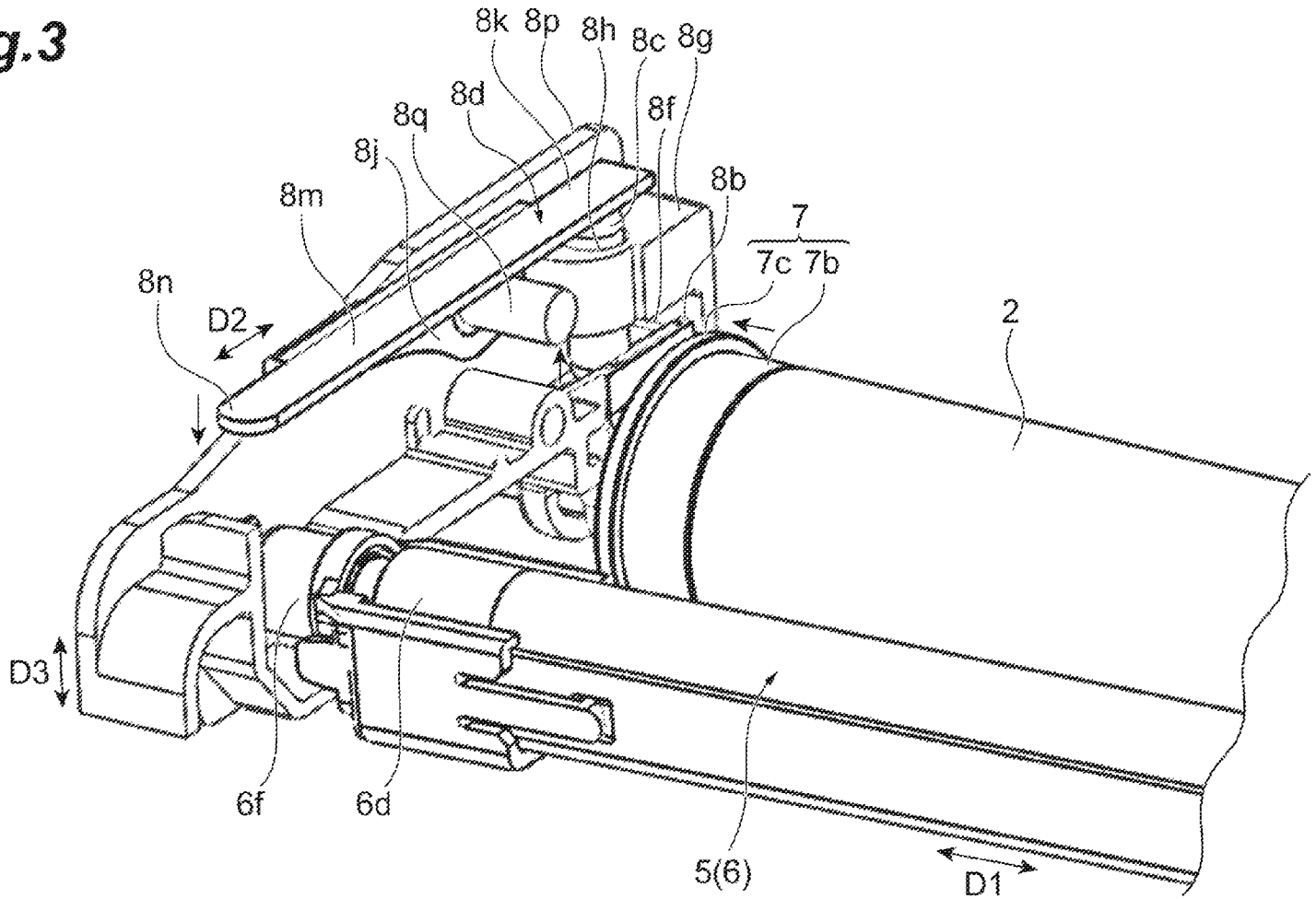
FIG. 3 is a perspective view illustrating a first end portion of the steering member and of the first belt roller illustrated in FIG. 2.
Figure 4:
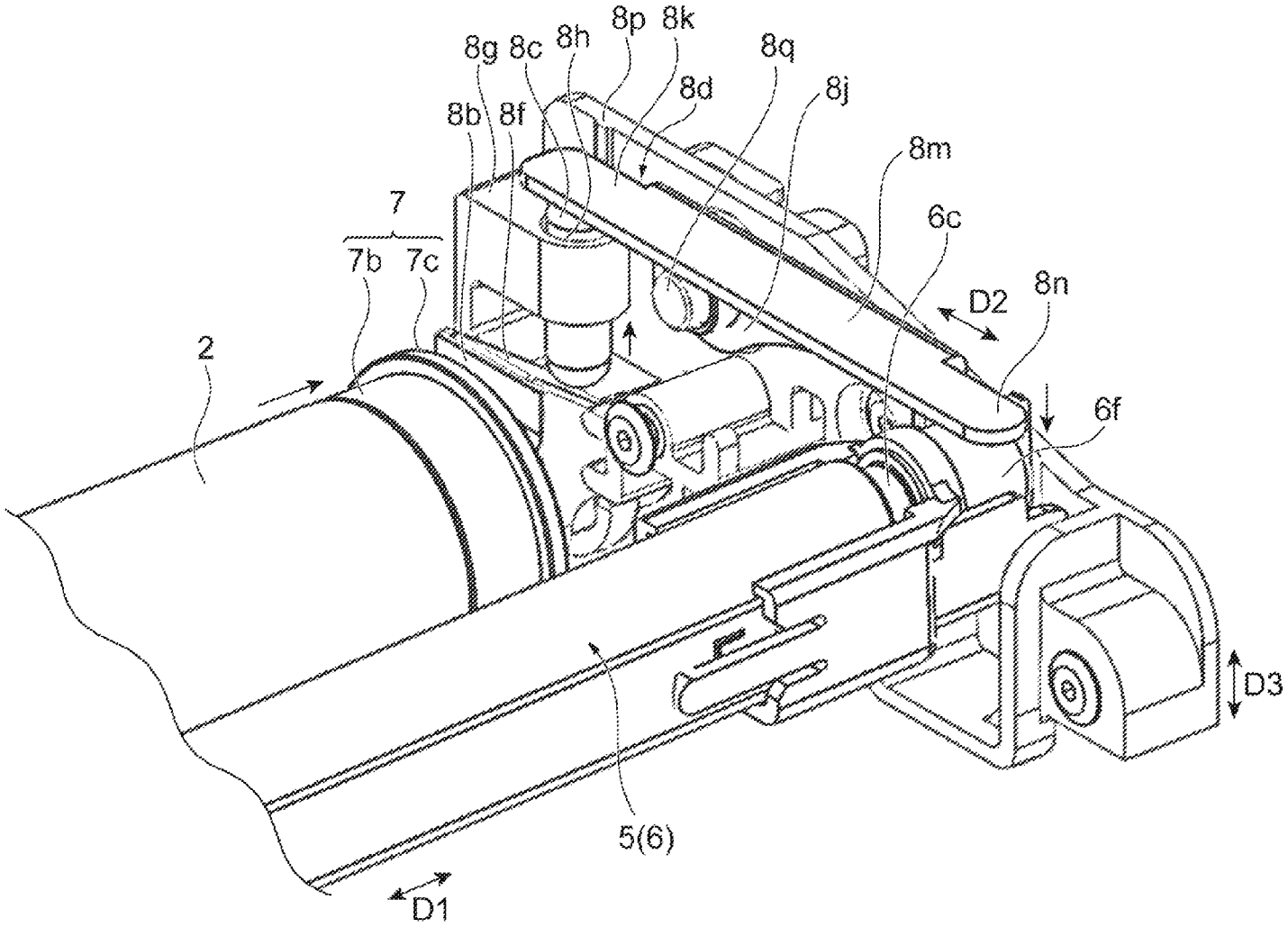
FIG. 4 is a perspective view illustrating an second end portion of the steering member and of the first belt roller illustrated in FIG. 2.

With reference to FIGS. 3 and 4, the pulley 7 may be inserted into an end portion of the first belt roller 2 in the direction D1 which is the axial direction. In some examples, the pulley 7 includes a cylindrical portion 7*b* and a flange portion 7*c* and is slidable in the direction D1. The first edge portion 4*b* or the second edge portion 4*c* of the endless belt 4 may be loaded on the outer circumferential surface of the cylindrical portion 7*b*. The flange portion 7*c* may be flared at one end of the cylindrical portion 7*b* in the direction D1 and an end surface directed outward in the radial direction of the flange portion 7*c* may protrude outward in relation to the outer circumferential surface of the endless belt 4.

The example lever mechanism 8 may include a target pressing portion 8*b* which is pressed against the pulley 7, an elevating portion 8*c* which contacts the target pressing portion 8*b*, and a lever portion 8*d* which moves up and down in accordance with the elevation of the elevating portion 8*c*. In some examples, the target pressing portion 8*b* is provided at a side opposite to the first belt roller 2 when viewed from the pulley 7 and moves along with the movement toward the end portion in the direction D1 of the pulley 7. The target pressing portion 8*b* may include an inclined surface 8*f* inclined in both of the direction D1 and the direction D3, and a lower end of the elevating portion 8*c* may contact the inclined surface 8*f*.

The elevating portion 8*c* moves upward along the direction D3 in accordance with the movement toward the end portion in the direction D1 of the inclined surface 8*f*. The lower end of the elevating portion 8*c* may have a round bar shape extending in the direction D3. In some examples, the lower end of the elevating portion 8*c* has a spherical shape. In some examples, the elevating portion 8*c* is held by a holding member 8*g* of a frame 8*p* located at the end portion side of the direction D1 to be movable in the direction D3. The holding member 8*g* may include an insertion hole 8*h* through which the elevating portion 8*c* is inserted. The elevating portion 8*c* may be inserted through the insertion hole 8*h* so that the movement in a direction other than the direction D3 is regulated.

The example lever portion 8*d* includes a fulcrum portion 8*j* which is provided between the elevating portion 8*c* and the first end 6*c* (the second end 6*d*) of the steering roller 6, a receiving portion 8*k* which receives an upward force of the elevating portion 8*c*, an extension portion 8*m* which extends from the fulcrum portion 8*j* to the first end 6*c* (the second end 6*d*), and a pressing portion 8*n* which presses the first end 6*c* (the second end 6*d*). As an example, the fulcrum portion 8*j* is supported by a support shaft 8*q* fixed to the frame 8*p*. The support shaft 8*q* extends from the frame 8*p* inward in the direction D1.

In some examples, the fulcrum portion 8*j* is rotatably supported by the support shaft 8*q* while the support shaft 8*q* is inserted therethrough. In some examples, the receiving portion 8*k*, the fulcrum portion 8*j*, the extension portion 8*m*, and the pressing portion 8*n* are arranged in this order in the direction D2. In this case, as the elevating portion 8*c* moves upward, the receiving portion 8*k* moves upward, the extension portion 8*m* and the pressing portion 8*n* move downward. As the elevating portion 8*c* moves downward, the receiving portion 8*k* moves downward, and the extension portion 8*m* and the pressing portion 8*n* move upward.

The first end 6*c* may include a bearing receiving portion 6*f* which accommodates the bearing of the steering roller 6. The pressing portion 8*n* of the lever portion 8*d* contacts an upper surface of the bearing receiving portion 6*f*. In some examples, a spring which urges the bearing receiving portion 6*f* upward may be built in the lower portion of the bearing receiving portion 6*f*. In some examples, when the pressing portion 8*n* moves downward, the bearing receiving portion 6*f* moves downward and the first end 6*c* of the steering roller 6 is tilted downward. Then, when the bearing receiving portion 6*f* and the pressing portion 8*n* are moved upward by the urging force of the spring, the first end 6*c* of the steering roller 6 is tilted upward. The second end 6*d* is tilted upward when the first end 6*c* is tilted downward. The second end 6*d* is tilted downward when the first end 6*c* is tilted upward.

In some examples, when the first edge portion 4*b* of the endless belt 4 is displaced to the pulley 7 (the first end 6*c* of the steering roller 6) by the steering roller 6, the pulley 7, and the lever mechanism 8, the pulley 7 and the target pressing portion 8*b* of the lever mechanism 8 move toward an end portion in the direction D1 as illustrated in FIG. 4. At the same time, the elevating portion 8*c* moves upward and the pressing portion 8*n* of the lever portion 8*d* presses the first end 6*c* of the steering roller 6 downward.

In some examples, when the first end 6*c* of the steering roller 6 is pressed downward, the steering roller 6 is tilted so that the second end 6*d* moves upward. When the first end 6*c* moves downward and the second end 6*d* moves upward, the tension of the endless belt 4 with respect to the second end 6*d* becomes higher than the tension of the endless belt 4 with respect to the first end 6*c*. As a result, the endless belt 4 moves toward the second end 6*d*. Since the endless belt 4 which is displaced to the first end 6*c* of the steering roller 6 moves toward the second end 6*d* by the pulley 7, the lever mechanism 8, and the steering roller 6, the displacement of the endless belt 4 toward the first end 6*c* is corrected. Accordingly, the steering member 5 including the steering roller 6, the pulley 7, and the lever mechanism 8 functions as a belt position correction member that corrects the displacement of the endless belt 4.

As described above, when the pulley 7 and the lever mechanism 8 are located in the first end 6*c*, the endless belt 4 displaced to the first end 6*c* can be moved toward the second end 6*d* and hence the displacement of the endless belt 4 can be corrected. In a comparison example, where the pulley 7 and the lever mechanism 8 are provided at the first end 6*c* exclusively (e.g., no pulley nor lever mechanism is provided at the second end 6*d*), in a state in which the first end 6*c* is higher than the second end 6*d* and the steering roller 6 is inclined, the first edge portion 4*b* of the endless belt 4 may repeatedly contact the pulley 7. Accordingly, the first edge portion 4*b* of the endless belt 4 may be easily abraded, which may in turn shorten the life of the endless belt 4.

In some examples, the pulley 7 and the lever mechanism 8 are respectively provided in the first end 6*c* and the second end 6*d*. In some examples, the pulley 7 which contacts the first edge portion 4*b* is a first belt meandering detection member and the pulley 7 which contacts the second edge portion 4*c* is a second belt meandering detection member. For example, when the first edge portion 4*b* of the endless belt 4 contacts the pulley 7, the first end 6*c* is pressed downward and the second end 6*d* moves upward so that the endless belt 4 moves toward the second end 6*d*. Accordingly, the displacement of the endless belt 4 toward the first end 6*c* is corrected.

Figure 5:
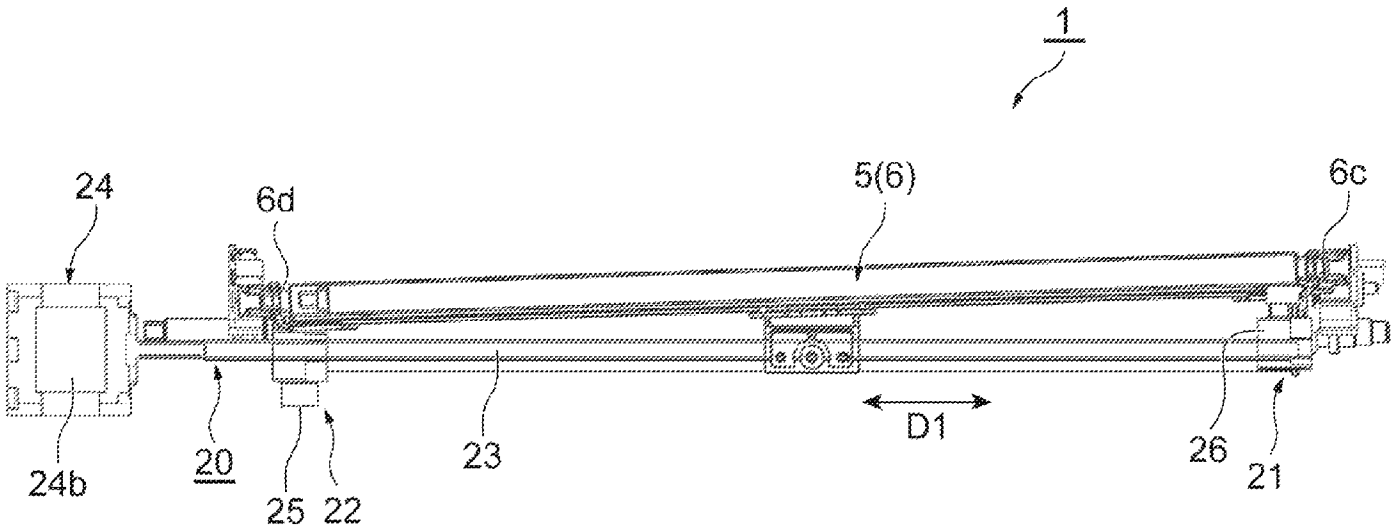
FIG. 5 is a side view of the steering member and the tilting mechanism illustrated in FIG. 2.

With reference to FIGS. 1, 2, and 5, the example belt driving device 1 includes a tilting mechanism 20 which tilts the steering member 5. The tilting mechanism 20 tilts the steering roller 6 in any one of a first mode in which the first edge portion 4*b* of the endless belt 4 contacts the pulley 7 and, a second mode in which the second edge portion 4*c* of the endless belt 4 contacts the pulley 7. FIG. 5 illustrates the steering member 5 of the second mode. Accordingly, since it is possible to prevent the first edge portion 4*b* from repeatedly (or continuously) contacting the pulley 7, it is possible to increase the life of the endless belt 4. For example, since the first mode in which the first edge portion 4*b* contacts the pulley 7 and the second mode in which the second edge portion 4*c* contacts the pulley 7 can be switched, it may be possible to double the life of the endless belt 4.

The tilting mechanism 20 may be connected to the steering member 5 so that the steering member 5 is tilted in the first mode in which the pulley 7 contacts the first edge portion 4*b* of the endless belt 4 and so that the steering member 5 is tilted in the second mode in which the pulley 7 contacts the second edge portion 4*c* of the endless belt 4. For example, the tilting mechanism 20 can be switched to the first mode in which the first end 6*c* is located below the second end 6*d* of the steering roller 6 and the second mode in which the second end 6*d* is located below the first end 6*c* of the steering roller 6.

Figure 6:
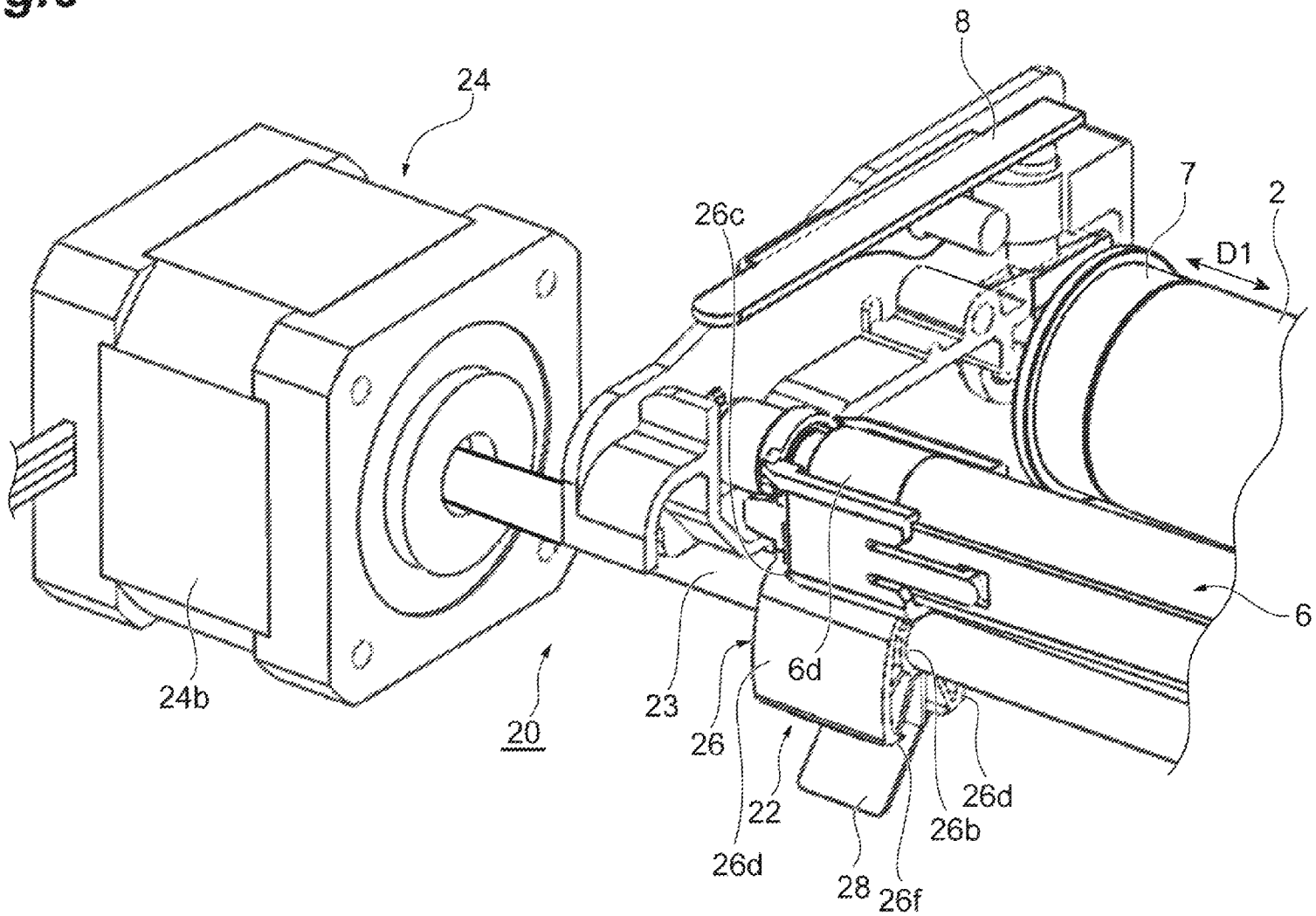
FIG. 6 is a perspective view illustrating a first end portion of the steering member and of the tilting mechanism illustrated in FIG. 5.
Figure 7:
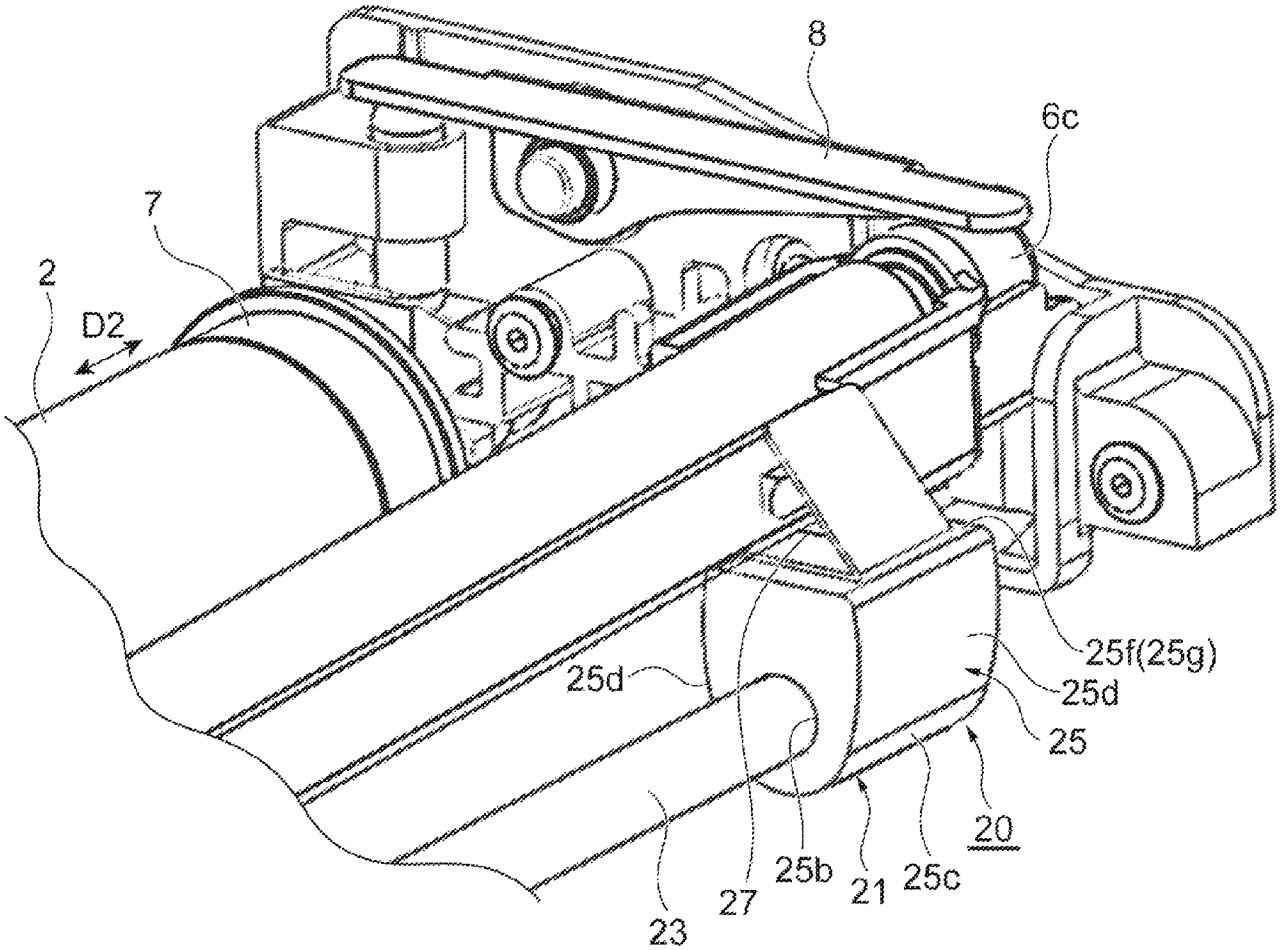
FIG. 7 is a perspective view illustrating a second end portion of the steering member and of the tilting mechanism illustrated in FIG. 5.

With reference to FIGS. 5, 6, and 7, an example tilting mechanism 20 may include a first actuator 21 which raises the first end 6*c* of the steering roller 6 toward the inner circumferential surface of the endless belt 4, and a second actuator 22 which raises the second end 6*d* of the steering roller 6 toward the endless belt 4.

In some examples, the tilting mechanism 20 includes a rotatable rod 23, a motor 24 which rotates the rod 23, a first cam 25 which is attached to a connection portion between the first end 6*c* and the rod 23, and a second cam 26 which is attached to a connection portion between the second end 6*d* and the rod 23. In some examples, the first actuator 21 includes the rod 23, the motor 24, and the first cam 25. In some examples, the second actuator 22 includes the rod 23, the motor 24, and the second cam 26.

The example rod 23 extends in the direction D1 along with the first belt roller 2 and the steering roller 6. In some examples, the rod 23 is formed in a round bar shape. One end of the rod 23 in the direction D1 is inserted into a casing 24*b* of the motor 24 and the rod 23 rotates by receiving a driving force from the motor 24. In some examples, the motor 24 is a stepping motor, but may be a different kind of motor.

In some examples, the rod 23 is inserted into both of the first cam 25 and the second cam 26. For example, the first cam 25 and the second cam 26 respectively include through-holes 25*b* and 26*b* which extend in the direction D1. The rod 23 is inserted into the through-holes 25*b* and 26*b*. The first cam 25 contacts the first end 6*c* of the steering roller 6. In some examples, the first cam 25 includes a first curved surface 25*c* which contacts the first end 6*c*, a pair of second curved surfaces 25*d* which extends from the circumferential end portion of the first curved surface 25*c*, and an enlarged diameter portion 25*f* which is located at the side opposite to the first curved surface 25*c* of each second curved surface 25*d*.

In some examples, the first curved surface 25*c* and each of the pair of second curved surfaces 25*d* are formed in a circular-arc shape. The curvature radius of each second curved surface 25*d* is larger than the curvature radius of the first curved surface 25*c*. The curvature radius of the first curved surface 25*c* may be substantially the same as the curvature radius of the rod 23. Further, the first curved surface 25*c* and the pair of second curved surface 25*d* may be formed in a parabolic shape. In some examples, the enlarged diameter portion 25*f* is a portion which is enlarged as compared with the first curved surface 25*c*. For example, the distance from the center of the rod 23 to the surface 25*g* of the enlarged diameter portion 25*f* may be longer than the distance from the center of the rod 23 to the first curved surface 25*c*.

The example tilting mechanism 20 may include a first spring portion 27 which is interposed between the first cam 25 and the first end 6*c* of the steering roller 6, and a second spring portion 28 which is interposed between the second cam 26 and the second end 6*d* of the steering roller 6. In some examples, the first spring portion 27 is a plate spring which protrudes from the enlarged diameter portion 25*f*. In other examples, the first spring portion 27 is not necessarily a plate spring and the type of spring of the first spring portion can be suitably modified.

In some examples, the second cam 26 includes a first curved surface 26*c* which is the same as the first cam 25, a pair of second curved surfaces 26*d*, an enlarged diameter portion 26*f*, and a second spring portion 28. The configuration of the second spring portion 28 may be the same as or similar to the configuration of the first spring portion 27. For example, the rotation position of the rod 23 in the first curved surface 25*c* and the enlarged diameter portion 25*f* and the rotation position of the rod 23 in the first curved surface 26*c* and the enlarged diameter portion 26*f* may have a reverse phase relationship. That is, each rotation position of the first curved surface 25*c* and the enlarged diameter portion 25*f* with respect to the rod 23 may be displaced by 180° from each rotation position of the first curved surface 26*c* and the enlarged diameter portion 26*f* with respect to the rod 23.

In this case, the first curved surface 26*c* is directed downward when the first curved surface 25*c* is directed upward, and the first curved surface 26*c* is directed upward when the first curved surface 25*c* is directed downward. The first end 6*c* of the steering roller 6 moves downward when contacting the first curved surface 25*c* and moves upward when contacting the enlarged diameter portion 25*f*. Similarly, the second end 6*d* of the steering roller 6 moves downward when contacting the first curved surface 26*c* and moves upward when contacting the enlarged diameter portion 26*f*.

As previously described, in the example imaging system including the belt driving device 1, the first mode in which the pulley 7 (the first belt meandering detection member) contacts the first edge portion 4*b* of the endless belt 4 and the second mode in which the pulley 7 (the second belt meandering detection member) contacts the second edge portion 4*c* of the endless belt 4 are switched by the tilting mechanism 20. For example, the first mode in which the first end 6*c* of the steering roller 6 moves downward with respect to the second end 6*d* and the second mode in which the second end 6*d* of the steering roller 6 moves downward with respect to the first end 6*c* can be switched.

Thus, it may be possible to switch a portion of the endless belt 4 contacting the pulley 7 to any one of the first edge portion 4*b* and the second edge portion 4*c* by switching the steering roller 6 to the first mode and the second mode. For example, a portion which receives a load of the endless belt 4 can be switched to any one of the first edge portion 4*b* and the second edge portion 4*c*. Accordingly, since it is possible to prevent one of the first edge portion 4*b* and the second edge portion 4*c* from contacting the pulley 7, it may be possible to increase the life of the endless belt 4 by preventing the abrasion of the endless belt 4.

The example tilting mechanism 20 may include the first actuator 21 which moves the first end 6*c* of the steering roller 6 toward the endless belt 4 and the second actuator 22 which moves the second end 6*d* of the steering roller 6 toward the endless belt 4. In this case, since the steering roller 6 can be elevated at each of both ends of the steering roller 6 in the direction D1, the first mode and the second mode can be reliably and smoothly switched.

The example tilting mechanism 20 may include the rotatable rod 23, the first actuator 21 may include the first cam 25 which is attached to a connection portion between the first end 6*c* of the steering roller 6 and the rod 23. The second actuator 22 may include the second cam 26 which is attached to a connection portion between the second end 6*d* of the steering roller 6 and the rod 23. In this case, the tilting mechanism 20 can have a simple configuration using a rod and a cam.

The example tilting mechanism 20 may include the first spring portion 27 which is interposed between the first cam 25 and the first end 6*c* of the steering roller 6, and the second spring portion 28 which is interposed between the second cam 26 and the second end 6*d* of the steering roller 6. In this case, since the first cam 25 and the first end 6*c* are in elastic contact with each other, and the second cam 26 and the second end 6*d* are in elastic contact with each other, the first mode and the second mode can be smoothly switched.

The example tilting mechanism 20 may further include the motor 24. In this case, when a switch is turned on, the motor 24 may be driven and the rod 23 is rotated so that the first mode and the second mode can be switched. Further, it is possible to automatically rotate the rod 23 by automatically driving the motor 24. Thus, it is possible to easily switch between the first mode and the second mode with a simple configuration.

Figure 8:
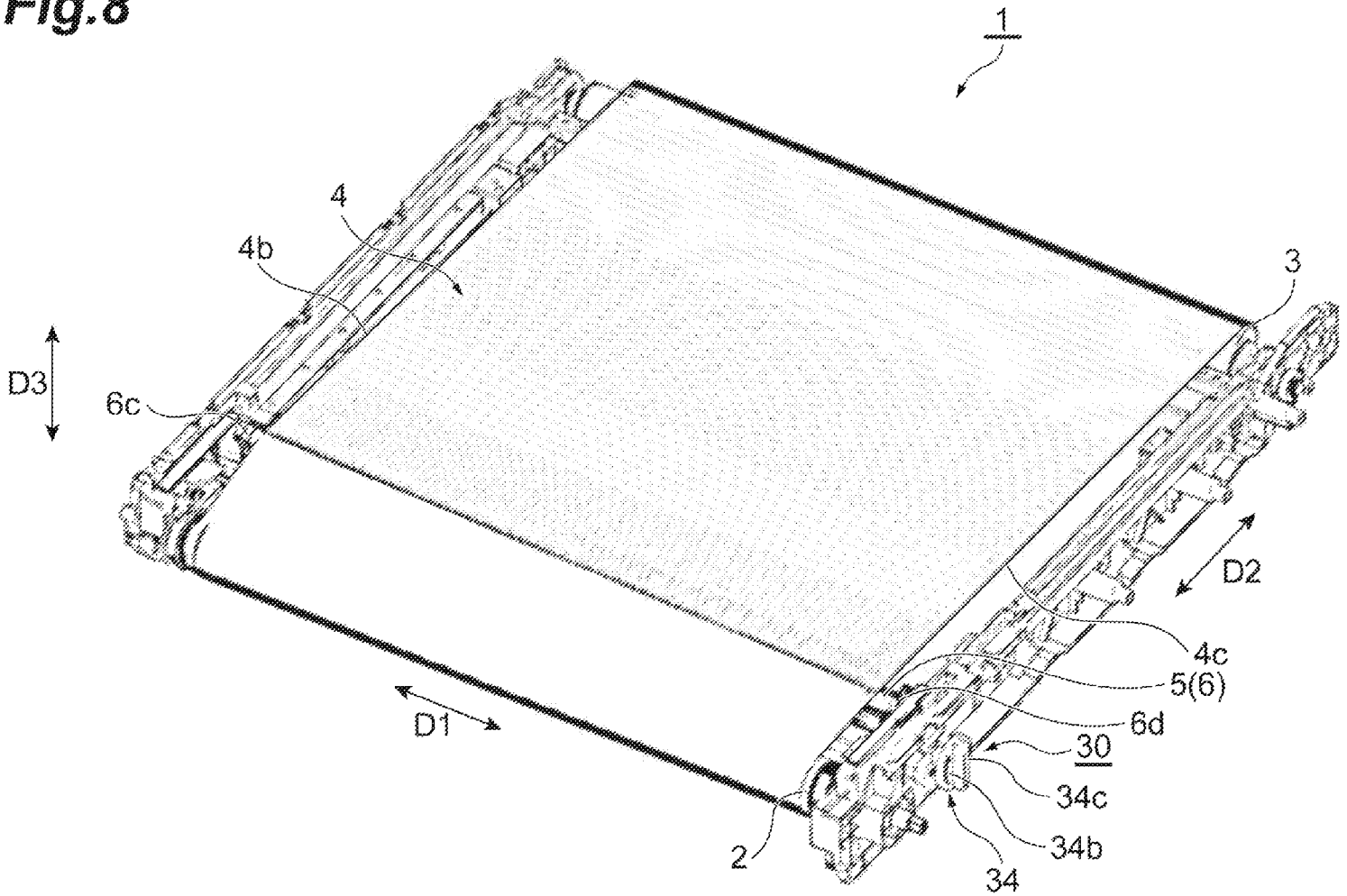
FIG. 8 is a perspective view of an example belt driving device.
Figure 9:
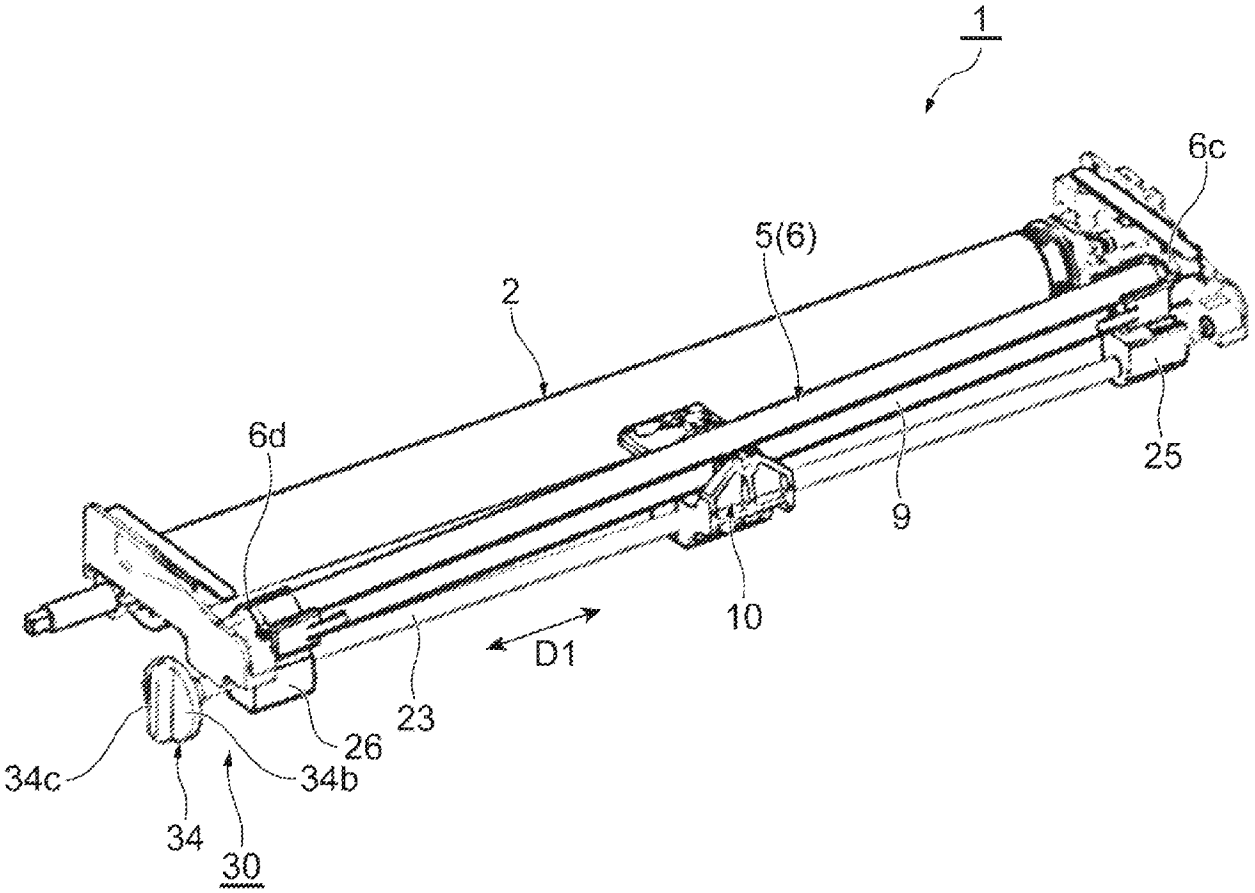
FIG. 9 is a perspective view of a steering member, a first belt roller, and a tilting mechanism of the belt driving device illustrated in FIG. 8.
Figure 10:
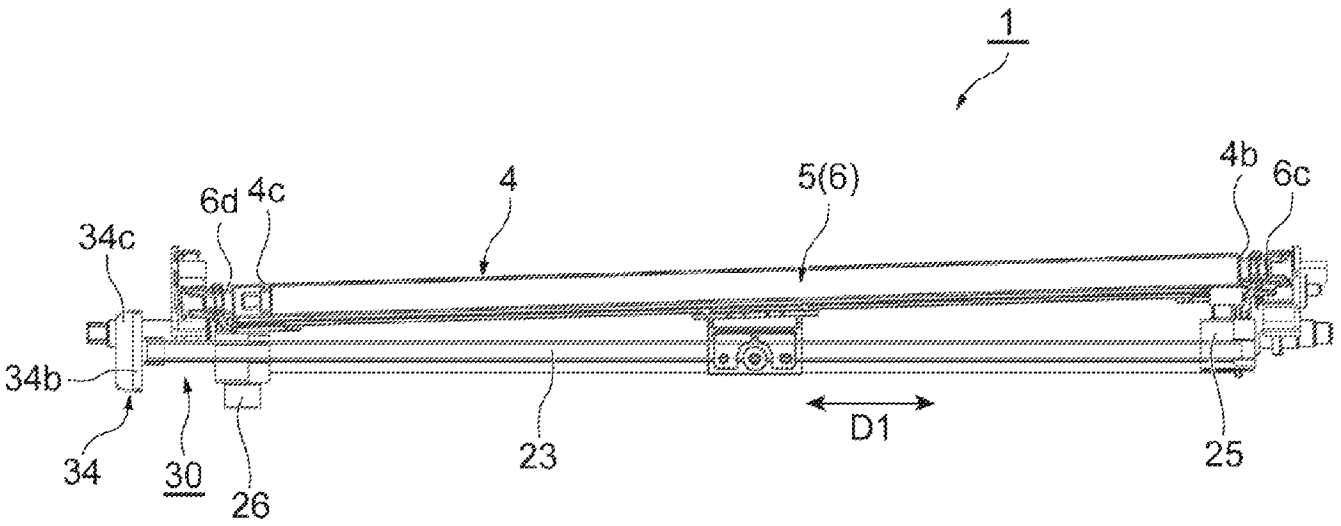
FIG. 10 is a side view of the steering member and the tilting mechanism illustrated in FIG. 9.

With reference to FIGS. 8, 9, and 10, an example tilting mechanism 30 includes a handle 34, instead of a motor (such as motor 24) to rotate the rod 23. In the tilting mechanism 30, the first mode and the second mode can be manually switched by using the handle 34.

The handle 34 may be rotatably attached to one end of the rod 23 in the direction D1. In an example, the handle 34 includes a plate-shaped base portion 34*b* which is fixed to one end of the rod 23 and extends in a direction intersecting the direction D1 and a knob portion 34*c* which protrudes from the base portion 34*b* toward the side opposite to the rod 23. In some examples, the shape of the knob portion 34*c* when viewed from the out-of-plane direction (direction D1) of the base portion 34*b* is a linear shape, and the handle 34 can be rotated by pinching.

The example tilting mechanism 30 includes the handle 34 which rotates the rod 23. Thus, a user of the imaging system including the tilting mechanism 30 may switch between the first mode and the second mode by rotating the handle 34. Further, since a drive source such as a motor is not necessary in the example tilting mechanism 30, the configuration of the tilting mechanism 30 can be further simplified.

Figure 11:
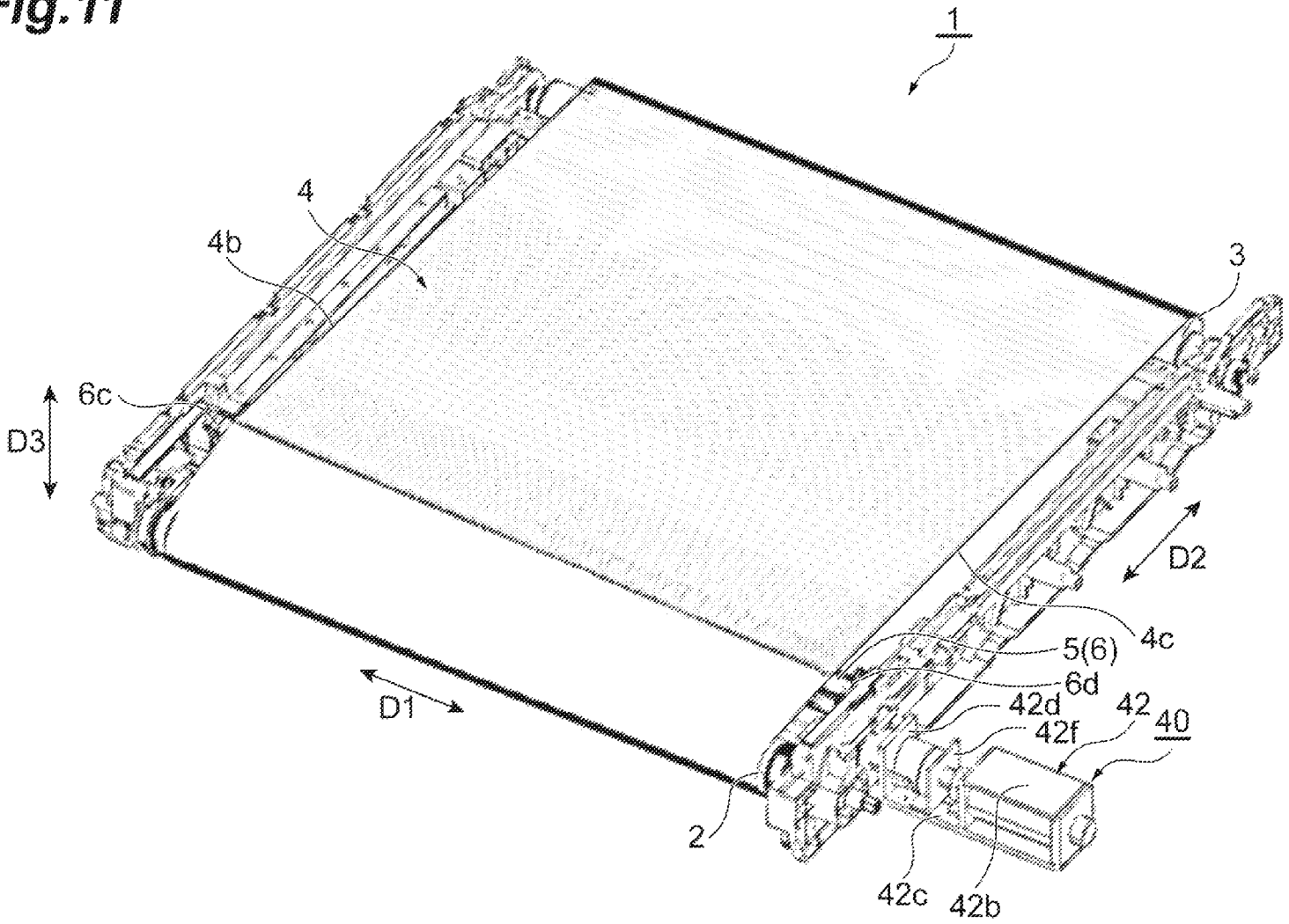
FIG. 11 is a perspective view of an example belt driving device.
Figure 12:
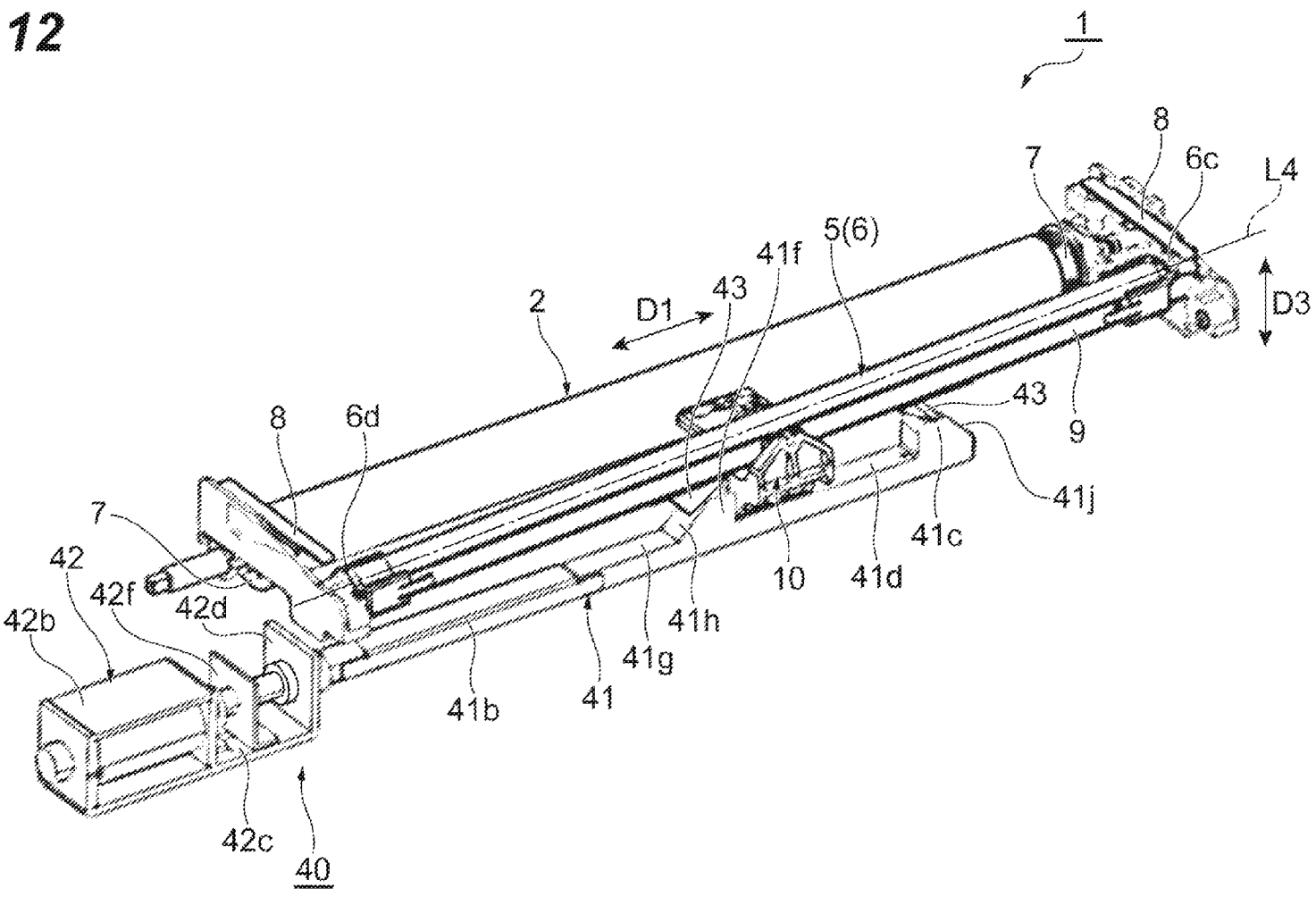
FIG. 12 is a perspective view of a steering member, a first belt roller, and a tilting mechanism of the example belt driving device illustrated in FIG. 11.
Figure 13:
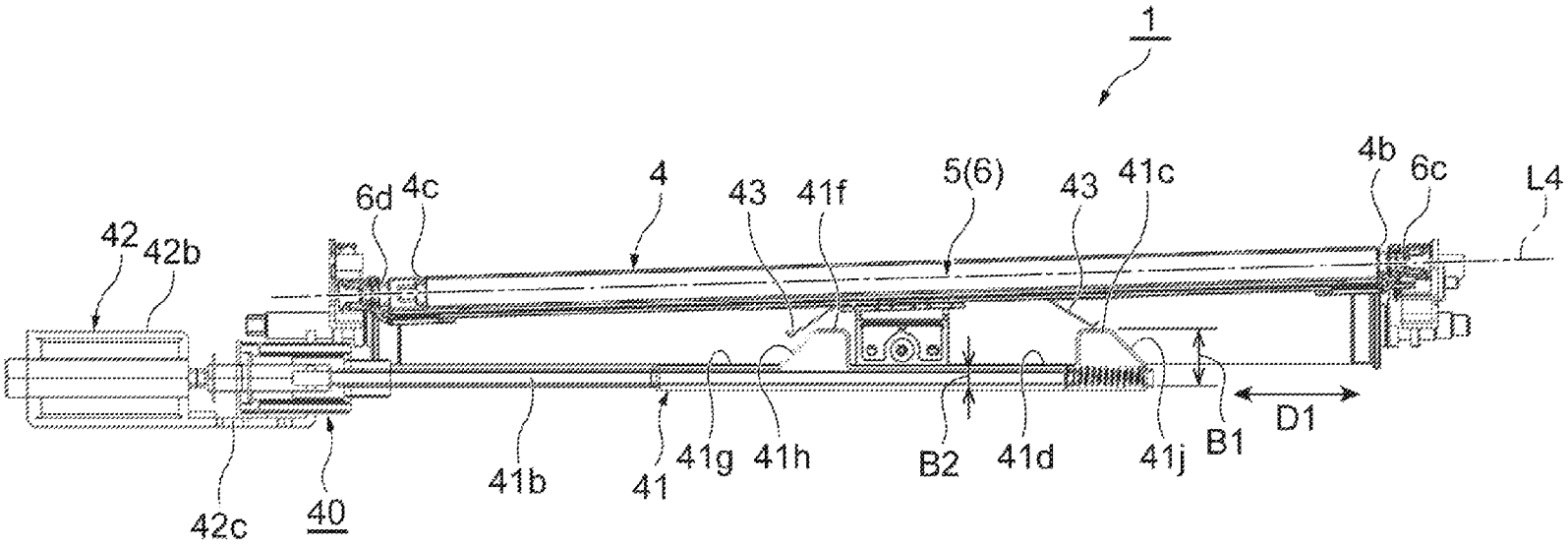
FIG. 13 is a side view of the steering member and the tilting mechanism illustrated in FIG. 12.

With reference to FIGS. 11, 12, and 13, an example tilting mechanism 40 may include a slide member 41 that slides along the axis L4 of the steering roller 6, a solenoid 42 which is an example of a drive source provided at one end of the slide member 41 in the direction D1, and a support portion 43 which protrudes from the steering roller 6 toward the slide member 41. The support portion 43 may include an elastic spring portion. The support portion 43 may include a plate spring for example. The solenoid 42 may slide the slide member 41 along the direction D1 and may include a casing 42*b* which accommodates an end portion of the slide member 41.

The slide member 41 may include a rod 41*b* which extends from the casing 42*b* of the solenoid 42. In some examples, the solenoid 42 includes a first plate-shaped portion 42*c* which from the lower side of the casing 42*b* inward in the direction D1 of the tilting mechanism 40, a second plate-shaped portion 42*d* which protrudes upward from the inner end portion of the first plate-shaped portion 42*c* in the direction D1, and a third plate-shaped portion 42*f* which protrudes upward from the first plate-shaped portion 42*c* between the casing 42*b* and the second plate-shaped portion 42*d*. The rod 41*b* which extends from the casing 42*b* may penetrate a through-hole of the second plate-shaped portion 42*d* and a through-hole of the third plate-shaped portion 42*f*. In this case, it is possible to more stably support the rod 41*b* via the solenoid 42.

The slide member 41 may include a convex portion 41*c* which is provided at a front end (or leading end) of the rod 41*b* to protrude toward the steering roller 6, a concave portion 41*d* which is located on the side of the convex portion 41*c* toward the solenoid 42, a convex portion 41*f* which is located on the side of the concave portion 41*d* toward the solenoid 42 to protrude toward the steering roller 6, and a concave portion 41*g* which is located at the side of the solenoid 42 of the convex portion 41*f*. For example, all of the convex portion 41*c* and the convex portion 41*f* protrude in a rectangular shape with respect to the concave portion 41*d*. A transition portion 41*h* in which the height of the rod 41*b* gradually increases from the concave portion 41*g* toward the convex portion 41*f* is provided between the convex portion 41*f* and the concave portion 41*g*. A transition portion 41*j* may be provided at the front end side (or leading end) in relation to the convex portion 41*c* of the rod 41*b*.

In some examples, the shapes of the transition portion 41*h* and the convex portion 41*f* may be symmetrical to the shapes of the transition portion 41*j* and the convex portion 41*c* with respect to the center portion of the concave portion 41*d* in the direction D1. In some examples, the tilting mechanism 40 includes a pair of support portions 43 which are arranged side by side in the direction D1. The steering roller 6 is supported to the slide member 41 by the pair of support portions 43. For example, the slide member 41 may slide in the direction D1 under the pair of support portions 43 and the contact position of each support portion 43 with respect to the convex portions 41*c* and 41*f* or the transition portions 41*h* and 41*j* changes so that the steering roller 6 is switched to the first mode or the second mode. In some examples, when the support portion 43 contacts the convex portion 41*c*, the steering roller 6 may be tilted so that the first end 6*c* moves upward. Then, when the support portion 43 contacts the convex portion 41*f*, the steering roller 6 may be tilted so that the second end 6*d* moves upward.

As described above, in the example tilting mechanism 40, the steering member 5 may include the steering roller 6, the tilting mechanism 40 may include the slide member 41 that slides in the axis L4 of the steering roller 6, and the slide member 41 may include the convex portions 41*c* and 41*f* which protrude toward the steering roller 6 and the concave portions 41*d* and 41*g* which are recessed with respect to the convex portions 41*c* and 41*f*. In this case, when the slide member 41 including the convex portions 41*c* and 41*f* and the concave portions 41*d* and 41*g* slides in the direction D1, the steering roller 6 can be switched between the first mode and the second mode.

The example tilting mechanism 40 may include at least one support portion 43 which is located between the steering roller 6 and the slide member 41. The tilting mechanism 40 may tilt the steering roller 6 when the support portion 43 moves to at least one of the convex portions 41*c* and 41*f* and the concave portions 41*d* and 41*g* of the slide member 41. In this case, it is possible to switch between the first mode and the second mode with a simple configuration using the convex portions 41*c* and 41*f*, the concave portions 41*d* and 41*g*, and the support portion 43.

The slide member 41 may include the pair of convex portions 41*c* and 41*f*. The concave portion 41*d* may be provided between the pair of convex portions 41*c* and 41*f*, and the concave portion 41*d* may be provided at a position facing the center portion (for example, the fixture 10) of the steering roller 6. In this case, since the concave portion 41*d* faces the center portion of the steering roller 6, the convex portions 41*c* and 41*f* and the support portion 43 are provided at both sides of the concave portion 41*d* in the direction D1. Accordingly, it is possible to more stably tilt the steering roller 6 by using the center portion of the steering roller 6 as an axis.

The width B1 of each of the convex portions 41*c* and 41*f* of the slide member 41 may be wider than the width B2 of each of the concave portions 41*d* and 41*g* of the slide member 41. The slide member 41 may include the transition portion 41*h* of which the height gradually increases from the concave portion 41*g* toward the convex portion 41*f* between the concave portion 41*g* and the convex portion 41*f*. In this case, it is possible to further stably tilt the steering roller 6.

The example tilting mechanism 40 may include a drive source which slides the slide member 41. The drive source may include the solenoid 42. In this case, for example, when a switch is turned on, the solenoid 42 may be driven and the slide member 41 may be slid to switch between the first mode and the second mode. In addition, it is possible to automatically slide the slide member 41 by automatically driving the solenoid 42. Accordingly, it is possible to easily switch the first mode and the second mode with a simple configuration.

Figure 14:
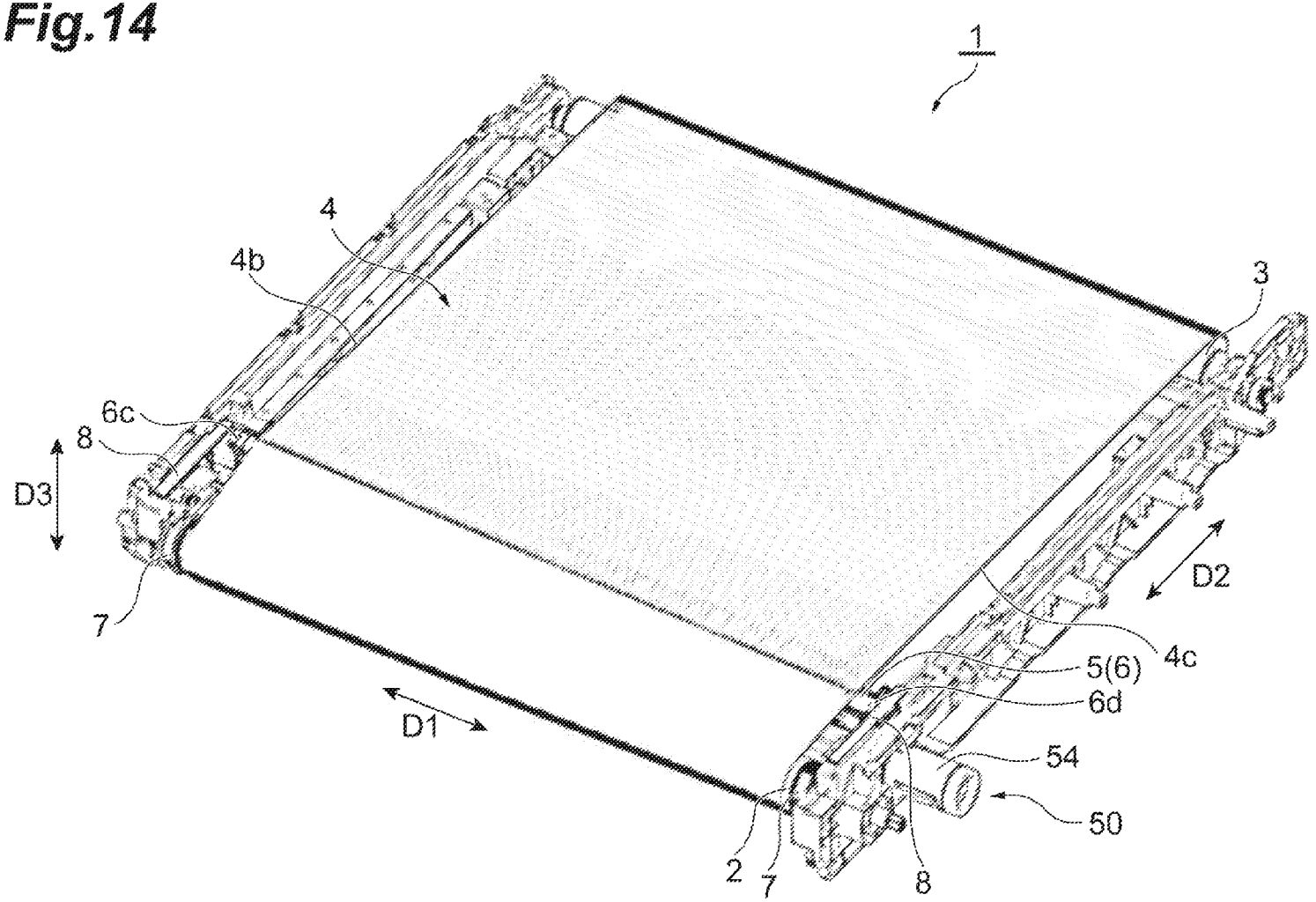
FIG. 14 is a perspective view of an example belt driving device.
Figure 15:
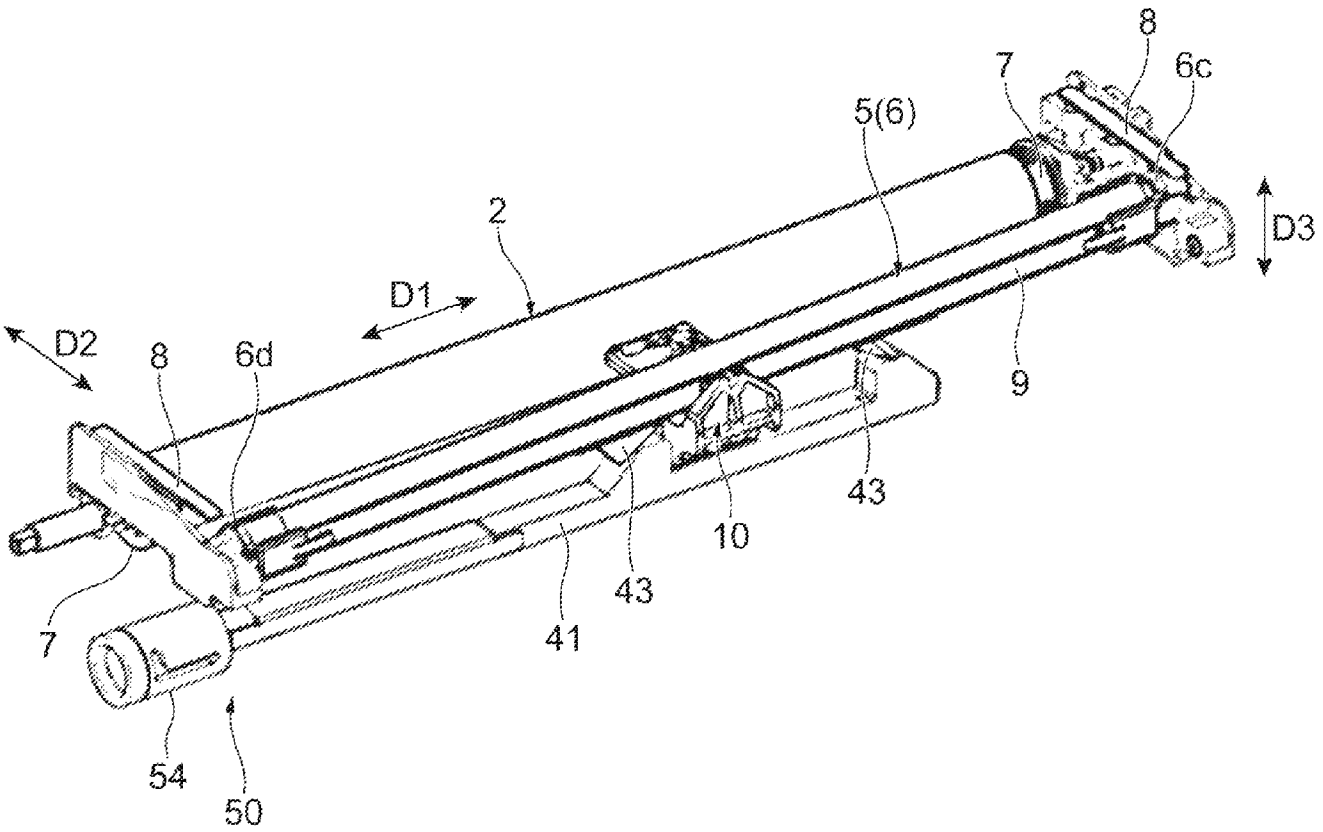
FIG. 15 is a perspective view of a steering member, a first belt roller, and a tilting mechanism of the belt driving device illustrated in FIG. 14.
Figure 16:
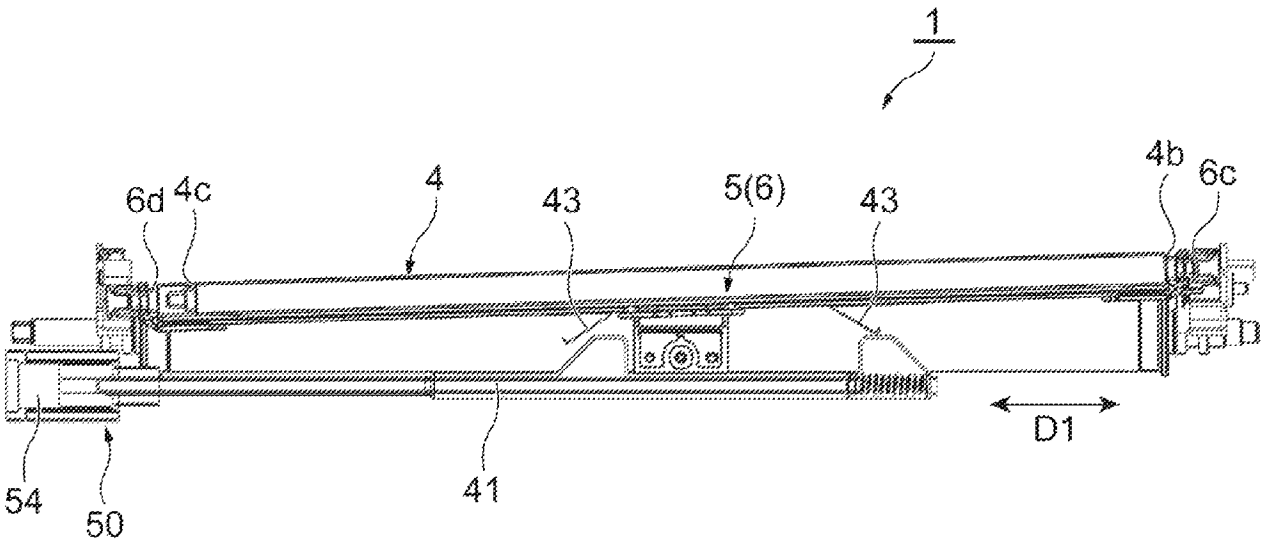
FIG. 16 is a side view of the steering member and the tilting mechanism illustrated in FIG. 15.

With reference to FIGS. 14, 15, and 16, an example tilting mechanism 50 may include an operation device 54 which slides the slide member 41 in the direction D1 instead of the solenoid 42. In the tilting mechanism 50, it is possible to switch between the first mode and the second mode by using the operation device 54.

In some examples, the operation device 54 is attached to one end of the slide member 41 in the direction D1 so that the slide member 41 can be pressed and pulled in the direction D1. In this case, the first mode and the second mode may be switched by pressing and pulling the operation device 54. In some examples, the operation device 54 may be pressed and pulled when the operation device 54 rotates in one direction (for example, a clockwise rotation direction), and may not be pressed and pulled when the operation device 54 rotates in a direction opposite to one direction while the slide member 41 is pulled. However, the configuration of the operation device is not limited to the configuration of the operation device 54 and can be modified suitably. For example, a button type operation device may be used.

As described above, the example tilting mechanism 50 may include the operation device 54 which slides the slide member 41. In some examples, a user of the imaging system including the tilting mechanism 50 can easily switch between the first mode and the second mode by operating the operation device 54. Further, since a drive source such as a solenoid is not necessary, the configuration of the tilting mechanism 50 can be further simplified.

Figure 17:
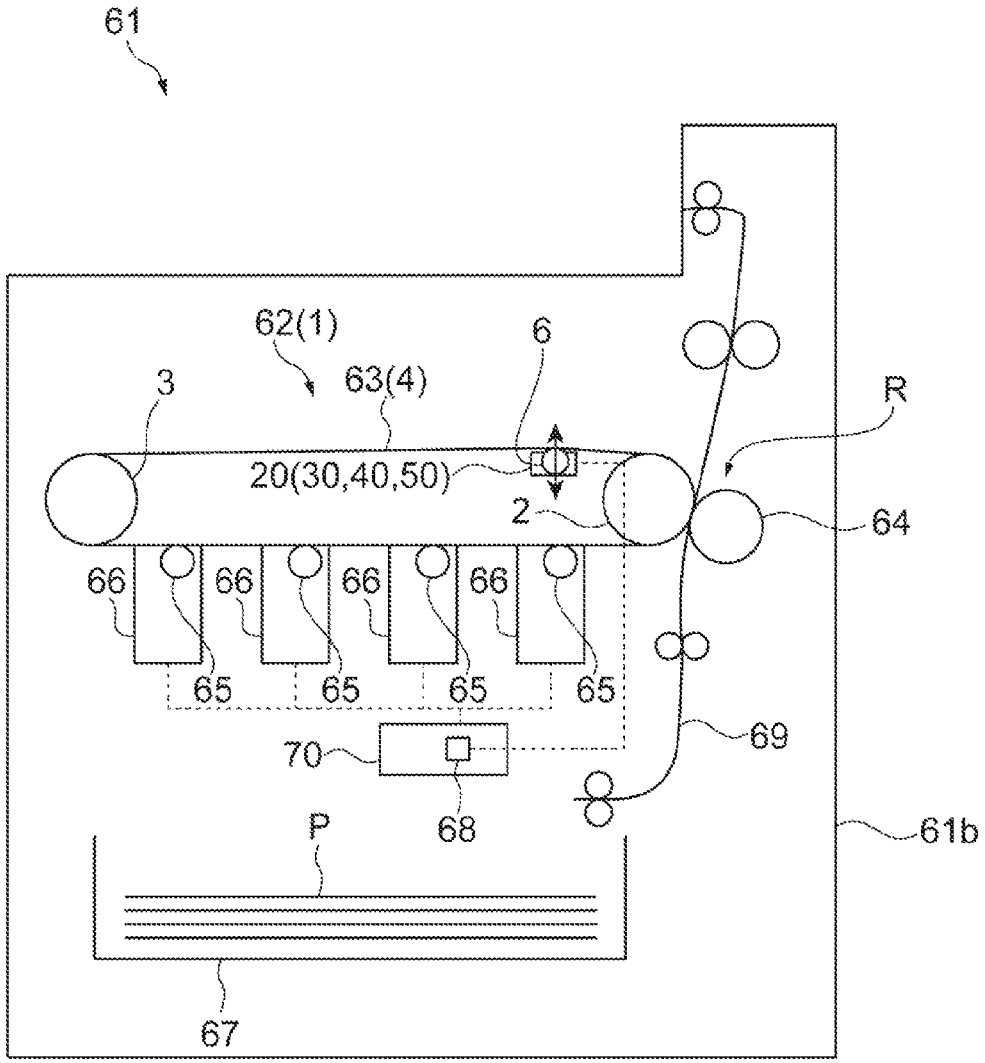
FIG. 17 is a schematic diagram of an example imaging system including an intermediate transfer device.

With reference to FIG. 17, an example imaging system 61 may include the belt driving device 1 as an intermediate transfer device 62. The imaging system 61 may be a color image forming apparatus which includes the intermediate transfer device 62. Furthermore, the example imaging system 61 is illustrated in a simplified manner in FIG. 17 in order to help the understanding of the drawing. The intermediate transfer device 62 may be any one of the belt driving device 1 including the tilting mechanism 20, the belt driving device 1 including the tilting mechanism 30, the belt driving device 1 including the tilting mechanism 40, and the belt driving device 1 including the tilting mechanism 50. The intermediate transfer device 62 includes the first belt roller 2, the second belt roller 3, an intermediate transfer belt 63 corresponding to the endless belt 4, and a secondary transfer roller 64.

The imaging system 61 may include a plurality of process cartridges 66 which respectively include a plurality of photoconductors 65 arranged in the movement direction of the intermediate transfer belt 63, a cassette 67 which accommodates a printing medium P of the imaging system 61, and a print count storage device 68 which stores a print count for the printing medium P other than the intermediate transfer device 62. The print count storage device 68 may be included in a control device 70 which controls a printing operation by the imaging system 61.

In some examples, the plurality of process cartridges 66 includes a photoconductor 65, a developing device, a charging device, and a cleaning device. In some examples, the imaging system 61 may include a housing 61*b* to which the plurality of process cartridges 66 are attached. Each process cartridge 66 may be attachable to or detachable from the housing 61*b* in such a manner that a door of the housing 61*b* is opened and the process cartridge 66 is inserted into or extracted from the housing 61*b*.

In some examples, the cassette 67 is opened and closed to accommodate the printing medium P. The printing medium P accommodated in the cassette 67 may be picked up and conveyed by a medium conveying device 69. The medium conveying device 69 may allow the printing medium P to reach a secondary transfer region R at a timing in which a toner image transferred to the intermediate transfer belt 63 of the intermediate transfer device 62 reaches the secondary transfer region R. The print count storage device 68 may store the number of the printing media P picked up from the cassette 67 and store the number of the printing media P reaching the secondary transfer region R. Accordingly, means in which the print count storage device 68 stores the print count of the printing medium P can be appropriately modified.

The intermediate transfer device 62 may include the steering roller 6 and the tilting mechanism 20. In this case, the first mode and the second mode are switched by the tilting mechanism 20. The tilting mechanism 20 may switch between the first mode and the second mode by driving the motor 24 and rotating the rod 23 at the time of opening the door of the housing 61*b* or attaching and detaching the process cartridge 66. In addition, when the intermediate transfer device 62 includes the tilting mechanism 40, the first mode and the second mode may be switched by driving the solenoid 42 and sliding the slide member 41 at the time of opening the door of the housing 61*b* or attaching and detaching the process cartridge 66.

The tilting mechanism 20 may switch between the first mode and the second mode by driving the motor 24 and rotating the rod 23 at the time of opening the cassette 67. The tilting mechanism 20 may switch between the first mode and the second mode when the print count stored in the print count storage device 68 is equal to or larger than a threshold value. Further, the imaging system 61 may include a measurement device which measures a traveling distance of the intermediate transfer belt 63 (e.g., the endless belt 4) and the tilting mechanism 20 may switch between the first mode and the second mode when the traveling distance of the intermediate transfer belt 63 measured by the measurement device is equal to or larger than the threshold value. In some examples, the threshold value is 100 km. Further, the imaging system 61 may store a rotation number storage device which stores the number of rotations of the intermediate transfer belt 63 (e.g., the endless belt 4) and the tilting mechanism 20 may switch between the first mode and the second mode when the number of rotations of the intermediate transfer belt 63 stored in the rotation number storage device is equal to or larger than the threshold value.

As described above, the example imaging system 61 may include the attachable/detachable process cartridge 66 and the tilting mechanism 20 may switch between the first mode and the second mode at the time of attaching and detaching the process cartridge 66. In this case, since it is possible to switch between the first mode and the second mode whenever attaching and detaching the process cartridge 66, it is possible to automatically switch the first mode and the second mode at an appropriate timing.

The imaging system 61 includes the cassette 67 which can accommodate the stacked printing media P and can be opened and closed and the tilting mechanism 20 may switch between the first mode and the second mode at the time of opening the cassette 67. In this case, since it is possible to switch between the first mode and the second mode whenever opening the cassette 67, it is possible to automatically switch between the first mode and the second mode at the time of opening the cassette 67.

The imaging system 61 may include the print count storage device 68 which stores a print count of the printing medium P and the tilting mechanism 20 may switch between the first mode and the second mode when the print count stored in the print count storage device 68 is equal to or larger than a threshold value. In this case, since it is possible to switch between the first mode and the second mode in response to the print count, it is possible to switch between the first mode and the second mode at an appropriate timing corresponding to the print count. Similar effects can be obtained in examples in which the imaging system 61 includes the tilting mechanism 30, in examples in which the imaging system 61 includes the tilting mechanism 40, and in examples in which the imaging system 61 includes the tilting mechanism 50.

It is to be understood that not all aspects, advantages and features described herein may necessarily be achieved by, or included in, any one particular example. Indeed, having described and illustrated various examples herein, it should be apparent that other examples may be modified in arrangement and detail.

For example, although the solenoid 42 has been described as a drive source for sliding the slide member 41 in some examples, the drive source for sliding the slide member may be one other than the solenoid. Further, in the above-described example, the tilting mechanism 20 including the first actuator 21 and the second actuator 22 has been described. However, the tilting mechanism may include a single one of the first actuator 21 moving the first end 6*c* of the steering roller 6 and the second actuator 22 moving the second end 6*d* of the steering roller 6. Accordingly, the configuration of the tilting mechanism can be suitably modified. Further, the configuration of the steering member, the configuration of the belt driving device, or the configuration of the imaging system, and/or the like, can be suitably modified.

The invention claimed is:

1. An imaging system comprising:

an endless belt which includes a first edge portion and a second edge portion located opposite to the first edge portion;

a tension roller to engage the endless belt, the tension roller having a first end adjacent the first edge portion of the endless belt and a second end adjacent the second edge of the endless belt;

a first belt meandering detection member located at the first end of the tension roller and a second belt meandering detection member located at the second end of the tension roller;

a steering roller to contact the endless belt; and a tilting mechanism to tilt the steering roller, the tilting mechanism to operate the steering roller between a first mode wherein the first edge portion of the endless belt contacts the first belt meandering detection member, and a second mode wherein the second edge portion of the endless belt contacts the second belt meandering detection member.

2. The imaging system according to claim 1, wherein the tilting mechanism includes a first actuator to move a first end of the steering roller toward the first edge of the endless belt in the second mode of the tilting mechanism, and a second actuator to move a second end of the steering roller toward the second edge of the endless belt in the first mode of the tilting mechanism.

3. The imaging system according to claim 2, wherein the tilting mechanism includes a rotatable rod, wherein the first actuator includes a first cam coupled to a first connection portion between the first end of the steering roller and the rod, and wherein the second actuator includes a second cam coupled to a connection portion between the second end of the steering roller and the rod.

4. The imaging system according to claim 3, comprising:
a motor to rotate the rod.

5. The imaging system according to claim 3, comprising:
a handle to rotate the rod.

6. The imaging system according to claim 3,
wherein the tilting mechanism includes a first spring portion located between the first cam and the first end of the steering roller, and a second spring portion located between the second cam and the second end of the steering roller.

7. The imaging system according to claim 1,
wherein the tilting mechanism includes a slide member to slide along an axis of the steering roller, and
wherein the slide member includes a convex portion which protrudes toward the steering roller and a concave portion which is recessed with respect to the convex portion.

8. The imaging system according to claim 7,
wherein the tilting mechanism includes at least one support portion which is located between the steering roller and the slide member, and
the tilting mechanism to tilt the steering roller when the support portion moves to at least one of the convex portion and the concave portion of the slide member.

9. The imaging system according to claim 8,
wherein the slide member includes a pair of the convex portions,
wherein the concave portion is located between the pair of convex portions, and
wherein the concave portion is located at a position facing a center portion of the steering roller.

10. The imaging system according to claim 7,
wherein the slide member includes a transition portion located between the concave portion and the convex portion, wherein the transition portion has a height that gradually increases from the concave portion toward the convex portion.

11. The imaging system according to claim 1,
wherein the steering roller is pivotally supported at a pivot support, and wherein the steering roller includes a support portion adjacent the pivot support, and
wherein the tilting mechanism includes a slide member to slidably engage the pivot support along an axis of the steering roller, the slide member having an inclined surface to engage the support portion of the steering roller,
the steering roller to tilt about the pivot support in response to the contact between the support portion and the inclined surface of the slide member.

12. The imaging system according to claim 11,
wherein the contact surface of the slide member includes a first inclined surface extending toward the steering roller and toward the pivot support, and a second inclined surface located opposite the first inclined surface relative to the pivot support, the second inclined surface extending toward the steering roller and toward the pivot support,
wherein the support portion of the steering roller includes a first support portion to contact the first inclined surface, and
wherein the steering roller includes a second support portion to contact the second inclined surface.

13. The imaging system according to claim 1, comprising:
a process cartridge that is attachable and detachable,
the tilting mechanism to switch between the first mode and the second mode at a time of attaching and detaching the process cartridge.

14. The imaging system according to claim 1, comprising:
a cassette which is able to accommodate stacked printing media and is openable and closeable,
the tilting mechanism to switch between the first mode and the second mode at a time of opening the cassette.

15. The imaging system according to claim 1, comprising:
a print count storage device to store a print count for a printing medium,
the tilting mechanism to switch between the first mode and the second mode when a print count stored in the print count storage device exceeds a threshold value.

* * * * *